US005793296A

United States Patent [19]

Lewkowicz

[11] Patent Number: 5,793,296

[45] Date of Patent: Aug. 11, 1998

[54] APPARATUS FOR CARBON MONOXIDE DETECTION AND AUTOMATIC SHUTOFF OF A HEATING SYSTEM

[76] Inventor: Mike Lewkowicz, 77 Pinewood Ave., West Long Branch, N.J. 07764

[21] Appl. No.: 640,159

[22] Filed: Apr. 30, 1996

[51] Int. Cl.[6] ..... G08B 17/10

[52] U.S. Cl. ..... 340/632; 340/581; 340/693; 431/16; 431/22

[58] Field of Search ..... 340/632, 633, 340/634, 539, 581, 693; 165/11.1, 200; 431/16, 22; 126/116 A

[56] References Cited

U.S. PATENT DOCUMENTS

| | | | |
|---|---|---|---|
| 3,789,231 | 1/1974 | Hayden | 340/632 |
| 4,526,028 | 7/1985 | Hubner | 340/632 |
| 4,665,385 | 5/1987 | Henderson | 340/539 |
| 4,891,629 | 1/1990 | Gajjar et al. | 340/632 |
| 4,893,113 | 1/1990 | Park et al. | 340/632 |
| 5,239,980 | 8/1993 | Hilt et al. | 126/116 A |
| 5,382,943 | 1/1995 | Tanaka | 340/539 |
| 5,394,934 | 3/1995 | Rein et al. | 165/16 |
| 5,477,913 | 12/1995 | Polk et al. | 165/11.1 |
| 5,576,379 | 11/1996 | Murphy | 340/632 |

*Primary Examiner*—Jeffery A. Hofsass
*Assistant Examiner*—Ashok Mannava

[57] ABSTRACT

An apparatus for carbon monoxide detection and automatic shutoff of a heating system is provided which includes a single housing containing a thermostat, a carbon monoxide detector, and a control circuit serially connected to the heating system via the existing thermostat wiring connections. The control circuit includes a relay with a plurality of contacts which are opened and closed to automatically control the operation of the furnace based on the operation of the carbon monoxide detector. In another embodiment, an existing thermostat is retrofitted by mounting the existing thermostat on an adapter plate containing an integrated carbon monoxide detector and control circuit. Another embodiment of the invention includes a carbon monoxide detector, a transmitter serially connected to the carbon monoxide detector for transmitting a predetermined radio frequency, and a receiver serially connected to the existing combustion-type furnace system for receiving the predetermined radio frequency from the transmitter. The transmitter communicates with the receiver to automatically shut down the furnace system based on the operation of the carbon monoxide detector.

7 Claims, 3 Drawing Sheets

APPARATUS FOR CARBON MONOXIDE DETECTION AND AUTOMATIC SHUTOFF OF A HEATING SYSTEM

FIELD OF THE INVENTION

This invention relates to an apparatus for controlling the operation of a heating system, and more particularly to an apparatus which, by combining the thermostat function of the heating system with a carbon monoxide detection function, provides for the detection of carbon monoxide and the automatic shutoff of the heating system, and the like.

BACKGROUND OF THE INVENTION

As is well known in the art, carbon monoxide is an odorless and colorless gas and is a byproduct of combustion-type heating systems. The presence of carbon monoxide above normal levels is often attributed to incomplete or improper combustion within the heating system. Because of the dangers associated with carbon monoxide poisoning, detection equipment is commonly used to alert occupants of a structure if unsafe levels of the gas are present. As a result of the increased concern over the dangers of carbon monoxide, many different types of carbon monoxide detectors are now currently available for sale to the public. These devices typically include a detection circuit which triggers an audible alarm to alert occupants of the presence of the gas. The benefits of these devices typically derive from the fact that the occupants are alarmed of the presence of carbon monoxide which would not otherwise be detectable by the human senses. However, while these devices are helpful in alerting the occupants of the dangerous gas, these devices do not effectively address the source of the problem, that typically being the heating system which produces the harmful gas in the first place. This shortcoming is illustrated by the device disclosed in U.S. Pat. No. 4,893,113 issued to Park et al. in which occupants are alerted by an alarm of the presence of carbon monoxide in the area immediately surrounding the heating system. As previously indicated, such a device goes no further than to just alarm the occupants of the presence of the gas even though the source of the gas, the heating system, is clearly identifiable.

Thus, to provide further protection to the occupants of a structure, advances have been made to provide a device for disabling the operation of a forced air furnace system based on the detection of abnormal carbon monoxide gas levels. Such a device is disclosed in U.S. Pat. No. 5,239,980 issued to Hilt et al. and in U.S. Pat. No. 5,477,913 issued to Polk et al. However, these devices have significant limitations in that both can only be used in conjunction with forced air furnace systems since the carbon monoxide detection sensor must be placed in either the exit air plenum of the furnace or the forced air ducts of the heating system. Moreover, these devices use a separate control circuit that requires a power source and external circuitry in order to communicate with the gas detection sensor and the heating system. Consequently, these devices fail to provide the user with a low-cost solution that can be readily implemented to retrofit existing furnace systems.

Therefore, while some advances have been made in devices that control the operation of furnaces in response to the detection of carbon monoxide gas, these advances have not yet produced a device that can be easily implemented to retrofit existing combustion-type furnaces of any type in a cost-effective manner.

SUMMARY OF THE INVENTION

Accordingly, it is an object of the present invention to provide an apparatus which controls the operation of a furnace or any portable heating system in response to the detection of carbon monoxide gas.

It is another object of the invention to provide an apparatus that combines the thermostat function of the furnace or any portable heating system with a carbon monoxide detection function so that existing physical connections can be used for retrofitting any combustion-type furnace systems or portable heating systems in a low-cost, easily implemented manner.

It is yet another object of the invention to provide an apparatus which remotely controls the operation of a furnace in response to the detection of carbon monoxide gas.

These and other objects of the invention are achieved by providing a device that uses the existing physical infrastructure of a heating system to control the operation of the heating system in response to the detection of carbon monoxide gas.

Illustratively, in a preferred embodiment of the invention, the apparatus comprises a thermostat means and a carbon monoxide detection means packaged within a single housing, and a relay circuit serially connecting the thermostat means and carbon monoxide detection means to the existing furnace circuitry. The relay circuit includes contacts which are opened and closed to automatically control the operation of the furnace based on the operation of the carbon monoxide detection means.

In another preferred embodiment of the invention, the apparatus comprises an adapter plate having a carbon monoxide detection means and a relay circuit. An existing thermostat is mounted on the adapter plate so that the relay circuit, carbon monoxide detection means, and the existing thermostat are serially connected. The relay circuit communicates with the existing thermostat to control the operation of the furnace based on the operation of the carbon monoxide detection means.

In each of these embodiments, the invention overcomes the limitations of the prior art by providing a user with a low-cost approach for retrofitting an existing heating system. Specifically, because the carbon monoxide detection in the present invention is not limited to sensing gas only within the air exit plenum or forced air ducts of a heating system, an apparatus according to the principles of the invention can therefore be used in conjunction with any type of combustion furnace system as well as any portable heating system employing a thermostat. Moreover, because the present invention integrates the relay circuit with the thermostat and carbon monoxide detection functions, the limitations of the prior art devices that use a separate control circuit are avoided. Of particular significance to the user, the retrofit of an existing heating system with the present invention does not require addition of any external circuitry, power sources, or the placement of external sensors in the heating system. Consequently, the present invention provides the user with a low-cost solution that can be readily implemented to retrofit existing furnace systems.

In another preferred embodiment of the invention, the apparatus comprises a carbon monoxide detection means, a transmitter means serially connected to the carbon monoxide detection means for transmitting a predetermined radio frequency, and a receiver means serially connected to the existing combustion-type furnace system for receiving the predetermined radio frequency from the transmitter means. The transmitter means communicates with the receiver means to automatically shut down the furnace system based on the operation of the carbon monoxide detection means.

BRIEF DESCRIPTION OF THE DRAWINGS

The features of the invention will be readily understood in light of the following Description of the Preferred Embodiments and the attached drawings, wherein.

DESCRIPTION OF THE PREFERRED EMBODIMENTS

Figure 1A:
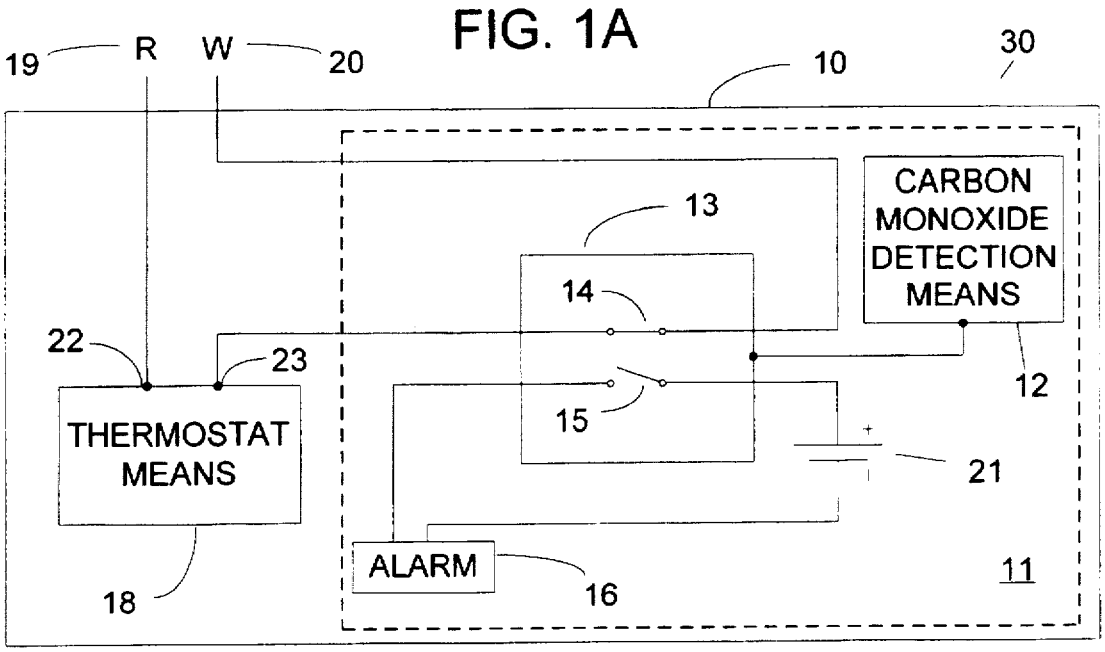
FIG. 1A is a schematic diagram showing a preferred embodiment of the invention under normal operating conditions.
Figure 1B:
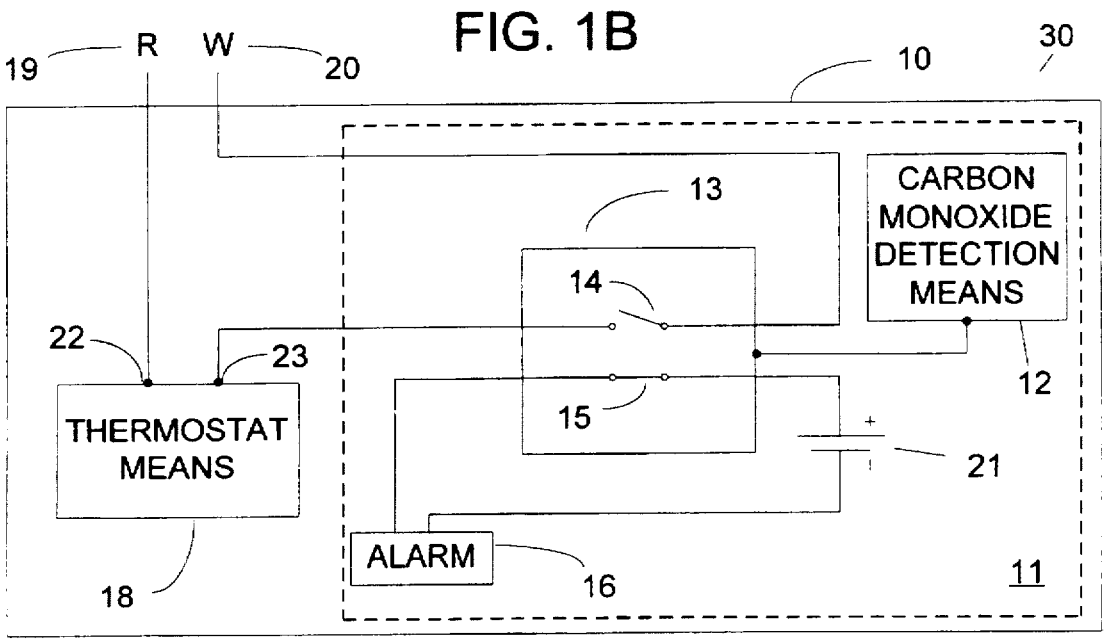
FIG. 1B is a schematic diagram showing a preferred embodiment of the invention in which an alarm condition is present.

For a more detailed appreciation of the invention, your attention is invited to FIGS. 1A and 1B which shows an apparatus for carbon monoxide detection with automatic shutoff of a heating system. Illustratively, in a preferred embodiment, an apparatus according to the principles of the invention comprises a thermostat means 18 having a first and second control line connection 22 and 23 respectively, said first control line connection 22 serially coupled to the heating system (not shown) via the R control line 19, a detection and control circuit means 11 serially coupled between the W control line 20 of the heating system and the second control line connection 23 of the thermostat means 18 for disabling the thermostat means 18 in response to the detection of a predetermined level of carbon monoxide. Thermostat means 18 and detection and control circuit means 11 are disposed in a housing 10.

The detection and control circuit means 11 comprises a relay circuit 13 including a first and second contact 14 and 15 respectively, said first contact 14 serially coupled between the W control line 20 of the heating system and the second control line connection 23 of the thermostat means 18, a carbon monoxide detection means 12 for generating an output signal in response to the detection of a predetermined level of carbon monoxide, said carbon monoxide detection means 12 coupled to the relay circuit 13 which is responsive to the output signal from the carbon monoxide detection means 12 for disabling the thermostat means 18, an alarm means 16 serially coupled to the second contact 15 of the relay circuit 13 for generating an alarm signal in response to the output signal of the carbon monoxide detection means 12, and a power source 21 serially coupled between the second contact 15 of the relay circuit 13 and the alarm means 16. The first and second contacts 14 and 15 of relay circuit 13 are electrically switched between an open and a closed position with the first contact 14 being electrically switched to a closed position and the second contact 15 being electrically switched to an open position for normal operation (FIG. 1A). In response to the output signal from the carbon monoxide detection means 12, the first contact 14 is electrically switched to an open position and the second contact 15 is electrically switched to a closed position (FIG. 1B).

In retrofitting an existing furnace system, housing 10 would be mounted in place of an existing thermostat so that thermostat means 18, carbon monoxide detection means 12, and relay circuit 13 are serially connected to the R and W control lines 19 and 20 from the heating system. Thermostat means 18 can be any suitable thermostat conventionally used for combustion-type heating systems. Carbon monoxide detection means 12 can be any suitable carbon monoxide detector adapted to communicate with relay circuit 13. Power source 21 can be any suitable power supply capable of providing power to operate the alarm means 16.

In operation, apparatus 30 (FIG. 1A) would be serially connected to a heating system (not shown) via the standard R and W control lines 19 and 20 which are normally used to interconnect a typical thermostat to the heating system. Under normal operating conditions in which abnormal levels of carbon monoxide gas are not present on the premises, the first contact 14 of relay circuit 13 (FIG. 1A) would be in a closed position while the second contact 15 of relay circuit 13 would be in an open condition. In this state, the R and W control lines 19 and 20 would be in a closed loop with thermostat means 18 so that the heating system (not shown) could be operated in accordance with the settings of thermostat means 18. Upon sensing the presence of abnormal carbon monoxide levels, the output signal from the carbon monoxide detection means 12 would trigger relay 13 as shown in FIG. 1B such that first contact 14 opens and second contact 15 closes. As first contact 14 opens, the circuit loop to thermostat means 18 is opened to disable thermostat means 18 thereby shutting down the heating system. Simultaneously, as second contact 15 is closed, the alarm means 16 is activated thus alerting any occupants in the structure as to the presence of carbon monoxide gas. Power source 21 is used to supply power to the alarm means 16. Alarm means 16 will remain activated and thermostat means 18 will remain disabled until the apparatus is reset to its normal operating condition. Because apparatus 30 is a self-contained device which uses the existing physical infrastructure of the heating system (e.g., existing wiring connections), there are no retrofitting constraints such as is the case with prior art devices. Namely, apparatus 30 provides the thermostat, carbon monoxide detection, and disabling circuit functions in a single package using the existing wiring from the conventional thermostat connections.

Figure 2:
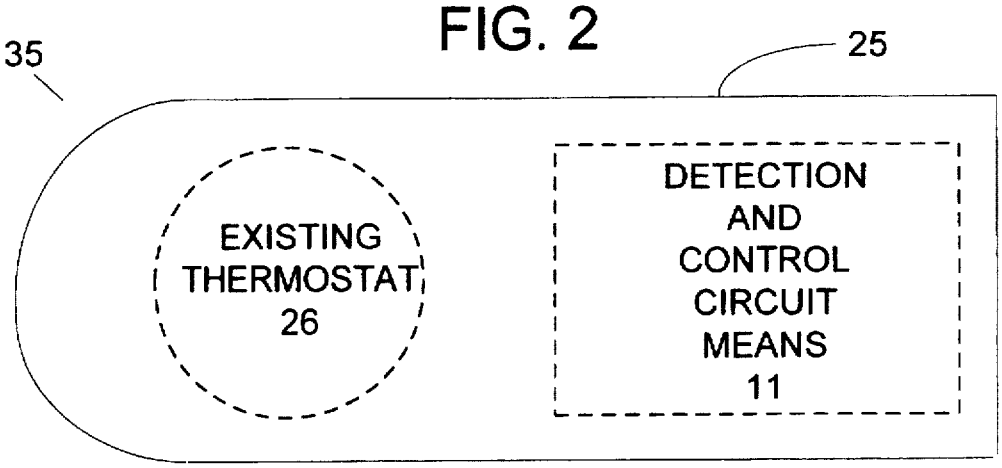
FIGS. 2, 3, and 4 are block schematic diagrams depicting variations of a second preferred embodiment of the invention helpful to understanding the integration of the invention with existing thermostat devices.

FIG. 2 shows another preferred embodiment of the invention in which the apparatus 35 comprises an adapter plate 25 and the detection and control circuit means 11. The detection and control circuit means 11 is disposed on the adapter plate 25. The adapter plate 25 is configured to receive an existing thermostat 26 of the heating system so that the existing thermostat 26 and the detection and control circuit means 11 are serially connected to the R and W control lines (not shown) from the heating system.

Figure 3:
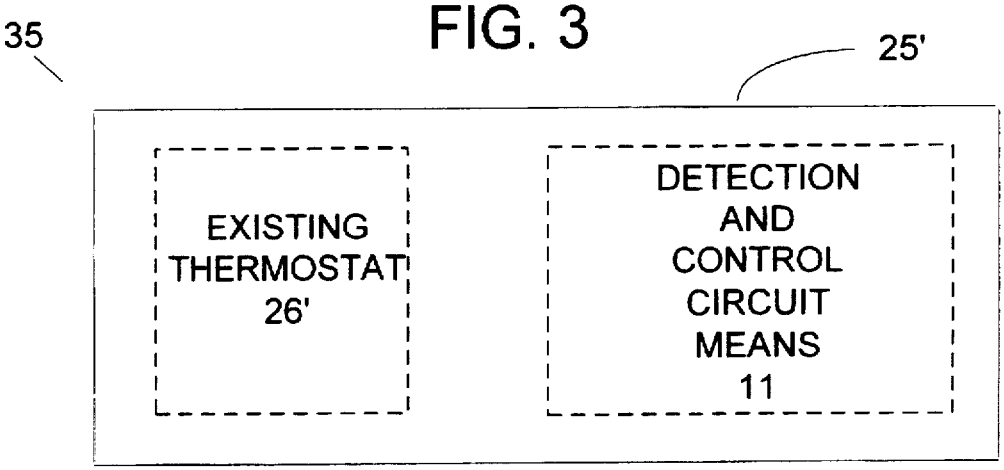
Figure 4:
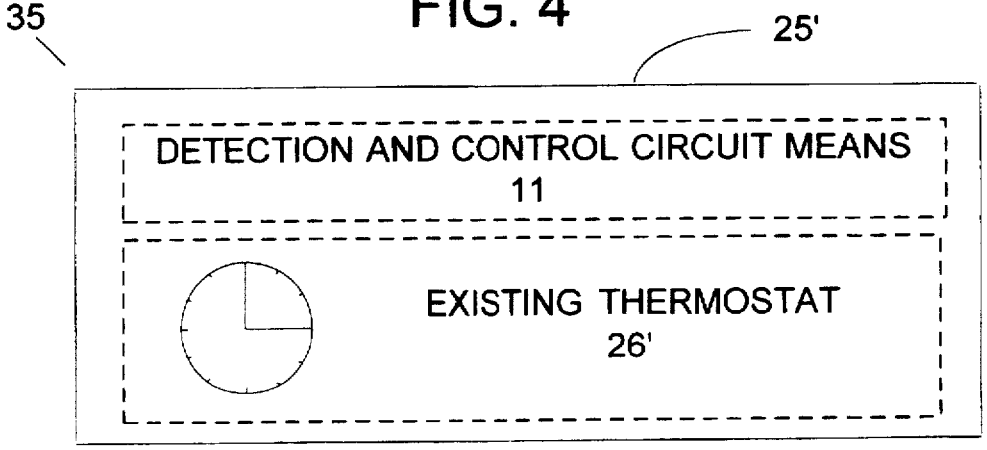

FIGS. 3 and 4 show further variations of the embodiment depicted in FIG. 2 whereby the adapter plate 25' is modified accordingly to receive and interface with thermostats 26' of varying designs. As is well known in the art, thermostat designs are produced in many different shapes and sizes with differing features (e.g., clock timers). The present invention is not limited in any way by the design of the thermostats because adapter plate 25 can be easily modified to receive and interface with any type of thermostat.

In operation, adapter plate 25 or 25' (FIGS. 2, 3, and 4) is mounted in the location where the existing thermostat was originally mounted. The existing thermostat 26 or 26' is mounted onto adapter plate 25 or 25' so that existing thermostat 26 or 26' and detection and control circuit means 11 are serially connected to the R and W control lines 19 and 20 (FIG. 1A). The apparatus 35 (FIGS. 2, 3, and 4) would function in the normal or alarm operating mode as previously described. Because the carbon monoxide detection and circuit disabling functions are integrated and packaged in the adapter plate 25 or 25', apparatus 35 offers a low-cost, easy-to-implement solution for retrofitting existing heating systems without having to replace the existing thermostat. Such an apparatus therefore overcomes the limitations of the prior art which require numerous modifications in the form of external circuitry, added power sources, and placement of external sensors.

Figure 5:
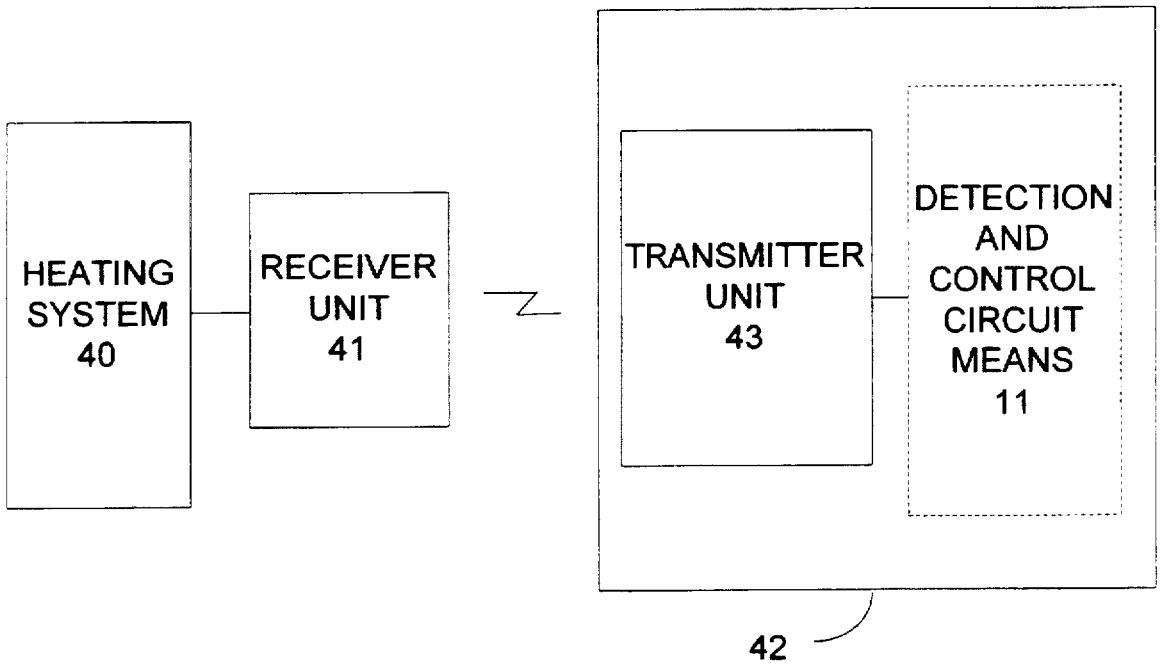
FIG. 5 is a block schematic diagram showing another preferred embodiment of the invention in a wireless configuration.

FIG. 5 shows another preferred embodiment of an apparatus for carbon monoxide detection with automatic shutoff of a heating system comprising a radio frequency receiver and control means 41 for receiving a predetermined radio frequency, said receiver and control means 41 being electrically coupled in series to the heating system 40, a radio frequency transmitter means 43 communicating with the receiver and control means 41 on the predetermined frequency, and the detection and control circuit means 11 electrically coupled in series to the transmitter means 43 for generating an output signal in response to the detection of a predetermined level of carbon monoxide. In response to the output signal, the receiver and control means 41 disables the heating system 40. Transmitter means 43 and receiver and control means 41 can be any suitable means for radio frequency transmission capable of providing remote control operation.

In operation, housing 42 is mounted in any location within the premises. The transmitter means 43 and receiver and control means 41 are programmed to operate at a predetermined frequency. Upon detecting abnormal levels of carbon monoxide gas, the detection and control circuit means 11 generates an output signal that causes transmitter means 43 to communicate with the receiver and control means 41 to automatically shut down the heating system 40. Because the apparatus is confined to operating within the premises, the chance for interference or other unnecessary signal disruption is minimal.

Although the present invention has been described in relation to several different embodiments, I wish it to be understood that I do not desire to be limited to the exact details of construction shown and described, since obvious modifications will become apparent to a person skilled in the art. Therefore, the present invention should not be construed to be limited by the specific disclosure, but only by the claims appended hereto.

What is claimed is:

1. An integrated apparatus for carbon monoxide detection and automatic shutoff of a heating system, comprising:

a housing;

a thermostat means having a first and second control line connection, said first control line connection serially coupled to the heating system; and an integrated detection and control circuit means colocated with said thermostat means, said integrated detection and control circuit means being serially coupled between the heating system and the second control line connection of said thermostat means for automatically disabling said thermostat means in response to the detection of a predetermined level of carbon monoxide, wherein said thermostat means and said integrated detection and control circuit means are disposed in said housing, and wherein said housing is retrofittably mountable to an existing thermostat connection of the heating system.

2. The integrated apparatus according to claim 1, wherein said integrated detection and control circuit means comprises:

a relay circuit having a first and second contact, said first contact serially coupled between the heating system and said second control line connection of said thermostat means;

a carbon monoxide detection means for generating an output signal in response to the detection of a predetermined level of carbon monoxide, said carbon monoxide detection means co-located with and coupled to said relay circuit, said relay circuit being responsive to said output signal from said carbon monoxide detection means, said relay circuit disabling said thermostat means in response to said output signal;

an alarm means serially coupled to the second contact of said relay circuit for generating an alarm signal in response to said output signal of said carbon monoxide detection means; and a power source serially coupled between the second contact of said relay circuit and said alarm means.

3. The integrated apparatus according to claim 2, wherein said first and second contacts of said relay circuit are electrically switched between an open and a closed position, said first contact being electrically switched to a closed position and said second contact being electrically switched to an open position for normal operation, said first contact being electrically switched to an open position and said second contact being electrically switched to a closed position in response to said output signal from said carbon monoxide detection means.

4. An integrated apparatus for carbon monoxide detection and automatic shutoff of a heating system, comprising:

an adapter plate for receiving an existing thermostat with a first and second control line connection to the heating system; and an integrated detection and control circuit means serially coupled between the heating system and the second control line connection of the existing thermostat for automatically disabling the thermostat in response to the detection of a predetermined level of carbon monoxide, said integrated detection and control circuit means disposed on said adapter plate, wherein said adapter plate provides for co-location and integration of the existing thermostat and said integrated detection and control circuit means as a single embodiment, and wherein said adapter plate is retrofittably mountable to an existing thermostat connection of the heating system.

5. The integrated apparatus according to claim 4, wherein said integrated detection and control circuit means comprises:

a relay circuit having a first and second contact, said first contact serially coupled between the heating system and the second control line connection of the existing thermostat;

a carbon monoxide detection means for generating an output signal in response to the detection of the presence of a predetermined level of carbon monoxide, said carbon monoxide detection means co-located with and coupled to said relay circuit, said relay circuit being responsive to said output signal from said carbon monoxide detection means, said relay circuit disabling the thermostat in response to said output signal;

an alarm means serially coupled to the second contact of said relay circuit for generating an alarm signal in response to said output signal of said carbon monoxide detection means; and a power source serially coupled between the second contact of said relay circuit and said alarm means.

6. The integrated apparatus according to claim 5, wherein said first and second contacts of said relay circuit are electrically switched between an open and a closed position, said first contact being electrically switched to a closed position and said second contact being electrically switched to an open position for normal operation, said first contact being electrically switched to an open position and said second contact being electrically switched to a closed position in response to said output signal from said carbon monoxide detection means.

7. In combination, a carbon monoxide detection and heating system control fixture comprising:

a housing retrofittably mountable to an existing thermostat connection of the heating system;

a thermostat means having a first and second control line connection, said first control line connection serially coupled to said existing thermostat connection of the heating system; and an integrated detection and control circuit means co-located with said thermostat means, said integrated detection and control circuit means being serially coupled between the existing thermostat connection of the heating system and the second control line connection of said thermostat means, said integrated detection and control circuit means communicating with said thermostat means to automatically disable said heating system upon detection of a predetermined level of carbon monoxide, wherein said thermostat means and said integrated detection and control circuit means are disposed in said housing.

* * * * *